US007669450B2

(12) United States Patent
Friedman et al.

(10) Patent No.: US 7,669,450 B2
(45) Date of Patent: Mar. 2, 2010

(54) PRESSURE CONTROLLED SUPERPLASTIC FORMING

(76) Inventors: Peter Friedman, 1706 Baldwin Pl., Ann Arbor, MI (US) 48104; Warren Copple, 2901 Blossom, Trenton, MI (US) 48183; George Luckey, Jr., 23829 Hollander, Dearborn, MI (US) 48128; Richard Allor, 36294 Clarita, Livonia, MI (US) 48152

( * ) Notice: Subject to any disclaimer, the term of this patent is extended or adjusted under 35 U.S.C. 154(b) by 0 days.

(21) Appl. No.: 12/256,935

(22) Filed: Oct. 23, 2008

(65) Prior Publication Data

US 2009/0145192 A1 Jun. 11, 2009

Related U.S. Application Data

(63) Continuation of application No. 11/000,185, filed on Nov. 30, 2004, now abandoned.

(51) Int. Cl.
*B21D 26/02* (2006.01)

(52) U.S. Cl. ..... 72/60; 72/709; 29/421.1

(58) Field of Classification Search ..... 72/58, 72/60, 61, 62, 364, 709; 29/421.1
See application file for complete search history.

(56) References Cited

U.S. PATENT DOCUMENTS

| | | | | | |
|---|---|---|---|---|---|
| 4,233,829 | A * | 11/1980 | Hamilton et al. | ..... | 72/38 |
| 4,266,416 | A * | 5/1981 | Festag et al. | ..... | 72/60 |
| 4,352,280 | A * | 10/1982 | Ghosh | ..... | 72/38 |
| 4,951,491 | A * | 8/1990 | Lorenz | ..... | 72/60 |
| 5,419,170 | A * | 5/1995 | Sanders et al. | ..... | 72/60 |
| 5,823,032 | A * | 10/1998 | Fischer | ..... | 72/60 |
| 6,067,831 | A * | 5/2000 | Amborn et al. | ..... | 72/58 |
| 6,182,486 | B1 * | 2/2001 | Chuang | ..... | 72/46 |
| 6,253,588 | B1 * | 7/2001 | Rashid et al. | ..... | 72/57 |

* cited by examiner

*Primary Examiner*—David B Jones
(74) *Attorney, Agent, or Firm*—Tung & Associates; Raymond L. Coppiellie

(57) ABSTRACT

The present invention provides a method and apparatus for forming a sheet of ductile material by superplastic forming. The gas pressure is varied to control the material flow during the forming process. Accordingly, the gas pressure can be increased or decreased to control the rate of deformation of the workpiece. Accordingly, the method and apparatus contemplates the use of predetermined pressure profiles to reduce the overall forming time.

11 Claims, 3 Drawing Sheets

PRESSURE CONTROLLED SUPERPLASTIC FORMING

RELATED APPLICATIONS

This application is a continuation of U.S. application Ser. No. 11/000,185 filed Nov. 30, 2004, which is now abandoned entitled "Pressure Controlled Superplastic Forming."

BACKGROUND OF THE INVENTION

1. Field of the Invention

The present invention relates generally to superplastic forming and more specifically to controlling the gas pressure during forming.

2. Description of Related Art

Superplastic forming (SPF) takes advantage of a material's superplasticity or ability to be strained past its rupture point under certain elevated temperature conditions. Superplasticity in metals is defined by very high tensile elongations, ranging from two hundred to several thousand percent. Superplasticity is the ability of certain materials to undergo extreme elongation at the proper temperature and strain rate. SPF is a process used to produce parts that are difficult to form using conventional fabrication techniques.

SPF typically is accomplished by heating a sheet of material to a point of superplasticity, clamping the material within a sealed die and then using inert gas pressure applied to one side of the sheet of material to force the material to stretch and take the shape of the die cavity. Pressure is controlled during the process to ensure the material maintains an appropriate deformation rate for superplasticity at the elevated temperature. Accordingly, superplastic materials can be stretched at higher temperatures by several times their initial length without breaking.

Typically SPF applications while having advantages over conventional stamping techniques, including increased forming strains, reduced spring back and low tooling costs, also have disadvantages in that they are limited to low volumes as they have relatively long cycle times. Specifically, a conventional SPF process used to manufacture a complex part can require a cycle time as high as 30 minutes.

Conventional SPF systems are relatively slow in terms of pressurization and have only moderate control of forming pressure. Early embodiments of SPF used a constant forming pressure. Once pressure in the die reached a target or predetermined target pressure, the pressure was held constant until the workpiece was formed by the gas pressure pressing the workpiece against the forming surface of the cavity. The use of a constant pressure throughout the forming cycle calls for long forming times. While faster forming times might be achieved if the pressure was simply increased during forming, there are periods when the forming process requires a relatively low pressure, typically at those points where the workpiece makes contact with the die surface, or when the material is formed at a rate where it may split or crack.

Prior systems were of the type having the ability to increase the pressure in the die cavity. These systems have a drawback. Once the pressure is increased, there is no way to lower the pressure in an accurate manner other than at the end of the forming cycle when the pressure is typically reduced through the activation of a quick exhaust or dump file. Thus the gas pressure profile could either be constant or increased through the forming cycle but not lowered.

Accordingly, in order to better utilize the SPF process for higher production volumes, such as those used in the automotive industry, it is critical that the process cycle time be reduced.

SUMMARY OF THE INVENTION

Accordingly, the present invention is a method and apparatus for managing the gas pressure used in a superplastic forming process. The superplastic forming process of the type using gas from the gas pressure source and a forming die against which the workpiece is pressed by the gas pressure to form the workpiece. The apparatus includes a valve assembly. The valve assembly is connected to the forming die and is operative to control the flow of gas from the gas pressure source into and out of the forming die.

A control unit communicating with the valve assembly controls the valve assembly to correspondingly manage the gas pressure. Thus, after the gas pressure within the forming die reaches a first gas pressure, the control unit operates to regulate the valve assembly to reduce the gas pressure in the forming die to a second gas pressure. The second gas pressure is at a level below the first gas pressure. Once the forming process is completed, the pressure is vented from the forming die prior to removing the formed workpiece.

The present invention further includes a method of forming a workpiece. The method includes providing a forming die including first and second die members that move between a first open position and a second sealed position. When the forming die is in the second sealed position a mold cavity is formed between the first and second die members. The workpiece is placed in the forming die and the first and second die members are moved to the second sealed position wherein the workpiece is secured in the mold cavity.

Gas pressure injected into the mold cavity on one side of the workpiece is used to form the workpiece by forcing the workpiece against a forming surface of the forming die. The gas pressure used to form the workpiece is managed such that it may be raised and lowered during the forming process. One advantage of varying the gas pressure during the forming process is that it enables the deformation rate of the workpiece to be controlled. Further, the deformation rate of the workpiece can be controlled depending upon the configuration of the forming surface of the forming die.

DETAILED DESCRIPTION OF THE INVENTION

Figure 1:
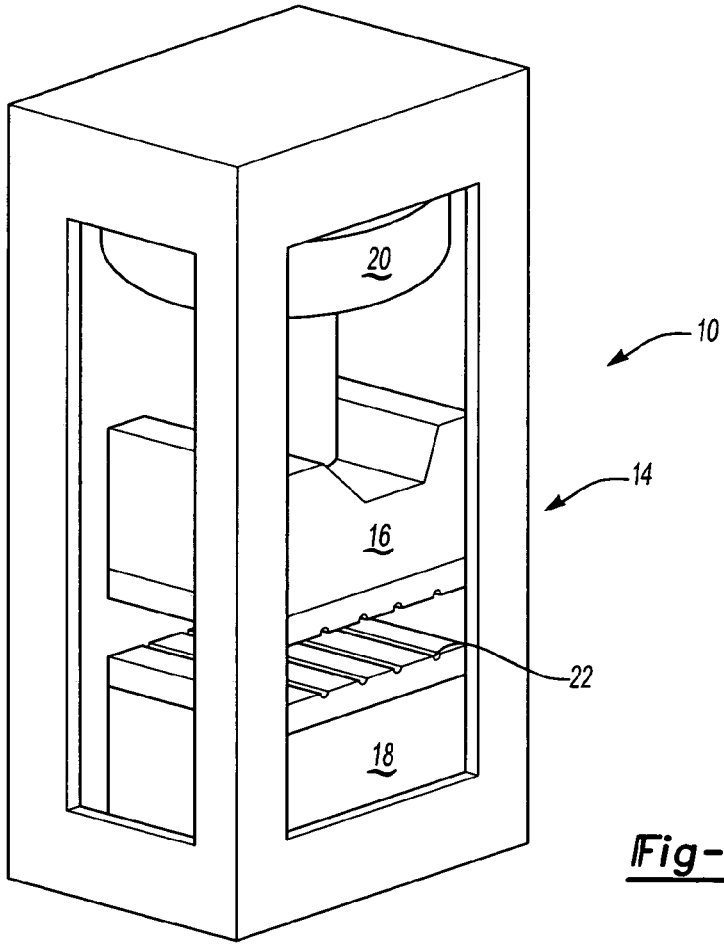
FIG. 1 is a schematic perspective view of a press assembly used in connection with an apparatus and method of the present invention.

Referring now to the drawings, FIG. 1 schematically illustrates a press assembly 10 used in connection with a superplastic forming apparatus according to the present invention. The press assembly 10 includes a frame 14 supporting upper and lower bolsters or die supports 16, 18. As shown, the lower bolster or die support 18 is secured to the frame 14 wherein the upper bolster or die support 16 is driven, in a known manner, between an upper and lower position by a press drive assembly, seen generally at 20.

As shown, a plurality of slots 22 are located in the upper and lower bolsters or die supports 16, 18. The slots 22 are used to secure respective portions of a forming die to the press assembly 10. In accordance with known press assemblies used for superplastic molding, the upper and lower bolsters 16, 18 are heated to help maintain the forming die and correspondingly the workpiece at suitable forming temperatures. In addition, insulated doors or panels may be placed on the sides of the press assembly 10 to aid in heat retention.

The foregoing description of a press assembly 10 is merely illustrative of a typical assembly used for superplastic forming of a workpiece. Other press assemblies or mechanisms used to open and close a forming die may be used and still come within the scope of the present invention.

Figure 2:
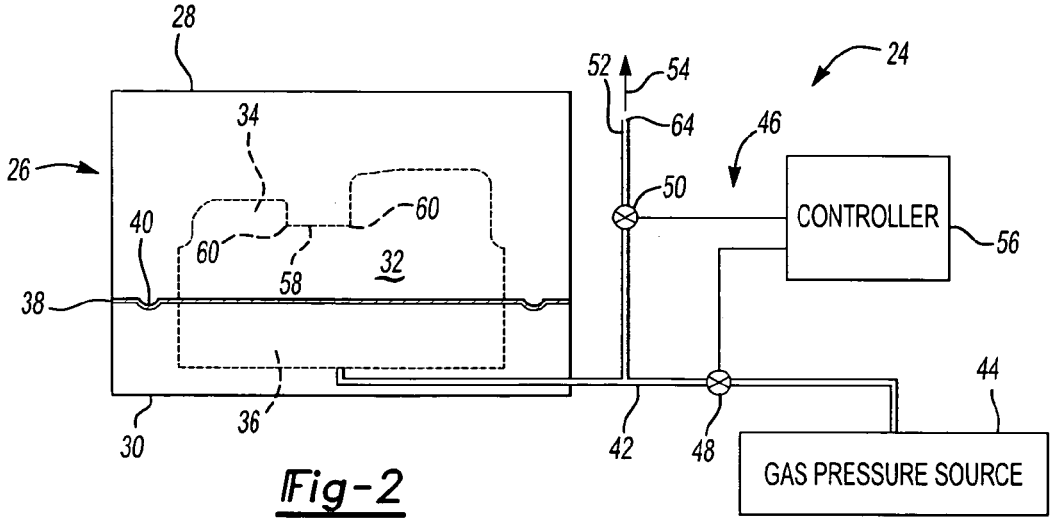
FIG. 2 is a schematic view of the apparatus according to the present invention for managing gas pressure used in a superplastic forming process.

Turning now to FIG. 2, there is shown a preferred embodiment of a superplastic forming apparatus 24 according to the present invention. The apparatus 24 includes a forming die 26 having upper and lower members or die shoes 28, 30. The upper and lower die shoes 28, 30 mate in a sealed relationship to form a mold cavity 32.

As shown, the workpiece 38 is positioned between the upper and lower die shoes 28, 30 such that when the upper and lower die shoes 28, 30 mate together, a seal ring or assembly, seen schematically at 40, forms a gas pressure seal between the upper and lower die shoes 28, 30. The workpiece 38 divides the mold cavity 32 into two areas or sections. As used herein, the upper portion or section 34 is the area above the workpiece 38 and the lower portion or section 36 is the area below the workpiece 38.

Thus, the superplastic forming process can be accomplished by supplying gas pressure to the mold cavity 32, on either side of the workpiece 38, specifically to one or both of the upper section 34 or the lower section 36 of the mold cavity 32. Injecting gas into the mold cavity 32 on either side of the workpiece 38 creates a differential gas pressure on opposite sides of the workpiece 38 which correspondingly acts on the workpiece 38 to deform the workpiece 38. Accordingly, gas pressure is used to press the workpiece 38 against a forming surface of the forming die 26.

The apparatus further includes a gas management system, seen generally at 46, for managing the gas pressure in the forming die 26. The gas management system 46 includes a gas inlet line 42 that supplies pressurized gas, for use in the superplastic forming process, from a gas pressure source 44 to the lower die shoe 30. A valve 48 is located on the gas inlet line 42. The valve 48 operates as a pressure regulator to regulate the pressure and pressurization rate of the gas supplied to the forming die 26. The valve 48 may be a proportional valve, a servo valve or any other type of valve that provides a closed loop flow or pressure response to an electrical or electronic control signal. Further, the valve 48 may be of any type that can be infinitely positioned to control the amount, pressure and direction of fluid flow.

The gas management system 46 further includes a second valve 50 located on a gas outlet line 52. Again, the valve 50 may be a proportional valve, a servo valve or any other type of valve that provides a closed loop flow or pressure response to an electrical or electronic control signal. Further, the valve 50 may be of any type that can be infinitely positioned to control the amount, pressure and direction of fluid flow. As shown in FIG. 2, the gas outlet line 52 is connected to the gas inlet line 42 at a point downstream from the valve 48. Thus, the valve 50 controls the gas flow from or exiting the forming die 26. The valve 50 may also function as an exhaust or vent valve, wherein the valve 50 is opened fully to vent or release the gas from the forming die 26 through the gas outlet line 52 and corresponding exhaust port 64 in the direction of the arrow 54. A separate vent or exhaust valve, typically a fast acting open or shut valve, may also be use to vent the gas from the forming die 26.

As used herein, vent or venting means describes the process of releasing or exhausting gas from the forming die 26 or mold cavity 32 once the gas pressure is no longer needed to form the workpiece 38. Accordingly, the gas pressure in the forming die 26 or mold cavity 32 is reduced from a forming pressure to a pressure substantially equal to atmospheric pressure. It should be understood that venting is not simply reducing the pressure in the forming die 26 or mold cavity 32 to atmospheric pressure but is reducing the pressure to substantially atmospheric pressure and not raising the pressure prior to removing the workpiece 38 from the forming die 26. The present invention contemplates a pressure profile in which the pressure in the forming die 26 or mold cavity 32 is reduced to lower forming pressure, even atmospheric and then raised once again to a forming pressure prior to ultimately releasing the pressure and removing the workpiece 38 from the forming die 26.

A controller or control unit 56 is connected to the valves 48, 50. The controller or control unit 56 may be a computer which is programmed with a predetermined or pre-selected pressure profile or pressure-time curve. Thus, the controller or control unit 56 operates the valves 48, 50 to regulate or control the pressure within the mold cavity 32.

Accordingly, the controller or control unit 56, in combination with the valves 48, 50, regulates the flow of gas both into and out of the forming die 26 and more specifically, in the embodiment shown in FIG. 2, the lower portion or section 36 of the mold cavity 32. In this way, the gas management system 46 of the present invention enables the application of gas pressure in accordance with a pressure profile, including a profile using a pressure-time curve involving both increasing and decreasing pressures.

The valving scenario illustrated in FIG. 2, that is the two proportional valves 48, 50 controlled by a controller or control unit 56, can be used to achieve a variety of pressure-time curves. The present invention is such that it enables the application of gas pressure used to form a workpiece 38 pursuant to a complex pressure-time curve involving both increasing and decreasing the gas pressure prior to venting or exhausting the gas from the forming die 26. Accordingly, a system using either a combination of valves or a single proportional or similar type valve, that is capable of both increasing and decreasing the gas pressure in the mold cavity 32 prior to venting or exhausting the gas comes within the scope of the present invention.

Figure 3:
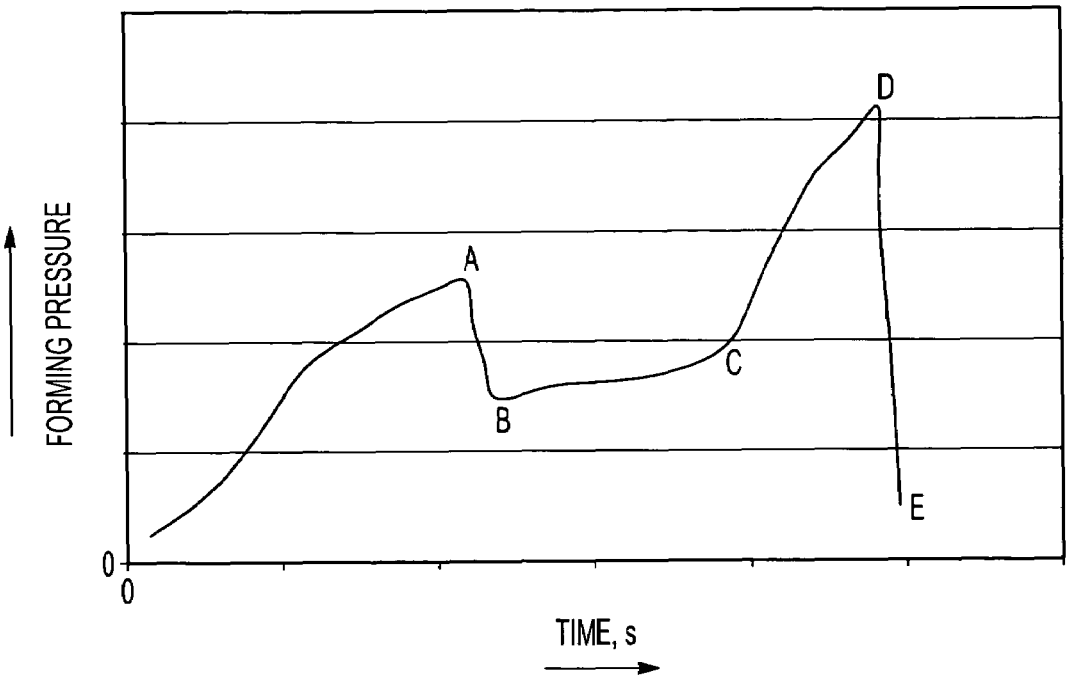
FIG. 3 is a graph of one embodiment of a pressure-time curve illustrating the gas pressures used in a superplastic forming process.
Figure 4A:
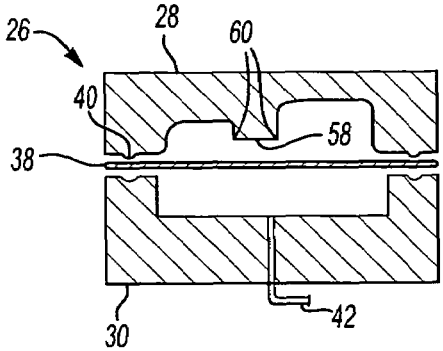
FIGS. 4A-4C are schematic representations of a workpiece undergoing a superplastic forming process in accordance with the apparatus and method of the present invention.
Figure 4B:
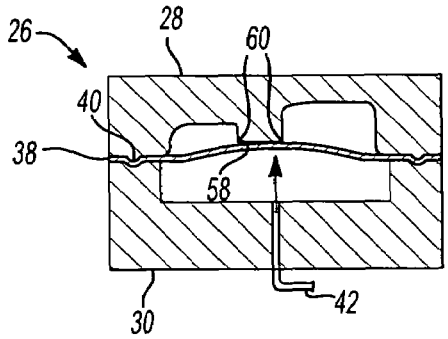
Figure 4C:
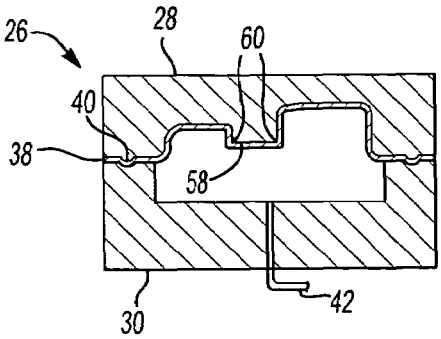

Turning now to FIG. 3 and FIGS. 4A-4C, FIG. 3 illustrates an example of a pressure-time curve according to one embodiment of the present invention, while FIGS. 4A-4C show a schematic representation of a workpiece 38 formed in a forming die 26 using or in conjunction with the pressure-time curve of FIG. 3. At the beginning of the forming process, the workpiece 38 is preheated to a predetermined forming temperature, after which it is placed between the upper and lower die shoes 28, 30. The press assembly 10 operates to lower the upper die shoe 28 until it contacts the workpiece 38 and ultimately mates with the lower die shoe 30 wherein the seal assembly 40 forms a gas pressure seal between the upper and lower die shoes 28, 30.

The controller or control unit 56, having been preprogrammed with a specific pressure profile such as that shown in FIG. 3, operates as follows. First, the controller or control unit 56 checks to insure that the valve 50 located on the gas outlet line 52 is placed in a closed position. Next, the controller or control unit 56, operating in accordance with the pressure profile of FIG. 3, opens the valve 48 to enable gas from the gas pressure source 44 to flow into the lower portion or section 36 of the mold cavity 32. Accordingly, the gas pressure in the lower portion or section 36 of the mold cavity 32 is raised to a first pressure, point A on FIG. 3, whereby the gas pressure drives the workpiece 38 upward toward the forming surface 58 of the upper portion or section 34 of the mold cavity 32, see FIG. 4B.

It should be understood that the workpiece 38 is formed of a ductile material which is rate sensitive. That is, the gas pressure causes the material to stretch at a rate proportional to the amount of pressure; i.e., the greater the pressure the greater the stretch rate. As the gas pressure acts on the workpiece 38, the deformation is relatively constant throughout the workpiece 38, however, once the workpiece 38 touches or engages the forming surface 58, the deformation rate slows in the area of contact due to friction caused by the workpiece 38 sticking to the forming surface 58 of the upper portion or section 34 of the mold cavity 32.

Accordingly, the pressure-time of curve FIG. 3 is such that when the process reaches the first initial pressure, indicated by point A of the pressure-time curve, the workpiece 38 reaches the position shown in FIG. 4B. When the workpiece 38 encounters a forming surface 58 that has an area thereof with a tight radii 60, for example corners, this creates an area of high strain on the workpiece 38. Thus, it is advantageous to reduce the rate of deformation and go slowly to maintain high ductility of the workpiece 38 when forming the workpiece 38 over areas of the forming surface 58 having a tight radii 60. To slow the rate of deformation and maintain ductility of the workpiece 38, the gas pressure in the lower cavity portion or section 36 of the mold cavity 32 is reduced to a second pressure, indicated by point B of the pressure-time curve. As shown, the second pressure at point B is lower than the first pressure at point A.

Once the workpiece 38 is formed over the area of tight radii 60, the gas pressure in the lower cavity portion or section 36 of the mold cavity 32 may start to increase, point C of FIG. 3 and continue increasing for the remainder of the forming cycle to a third pressure, point D of FIG. 3, to insure that the workpiece 38 is fully formed against the forming surface 58, see FIG. 4C. Once the forming process is complete, the gas pressure is vented by the valve 50 acting as a dump or quick exhaust valve, shown in FIG. 3 as the rapid drop in pressure from point D to point E.

The pressure-time curve of FIG. 3 is based in part on the material or workpiece 38 to be formed in connection with the ultimate design or shape of the workpiece 38. Thus, the specific configuration of the pressure-time curve or pressure profile may be, and often is, different for each particular workpiece 38. Each pressure-time curve takes into consideration the material deformation rate to control the deformation rate depending upon the position of the workpiece 38 in the forming die 26. Accordingly, it should be understood that depending upon the configuration of the forming surface 58 of the forming die 26, various pressure-time curves could be utilized to properly control and decrease the forming time of the workpiece 38. Specifically, the gas pressure applied to the workpiece 38 may be increased when necessary to increase the deformation rate and correspondingly reduce the forming time; however, when necessary, the pressure can be lowered and the forming process slowed; i.e., the strain rate of the workpiece 38 may be reduced during certain periods of the forming process. Thus, the forming process is not limited by the slowest rate of material deformation.

Figure 5:
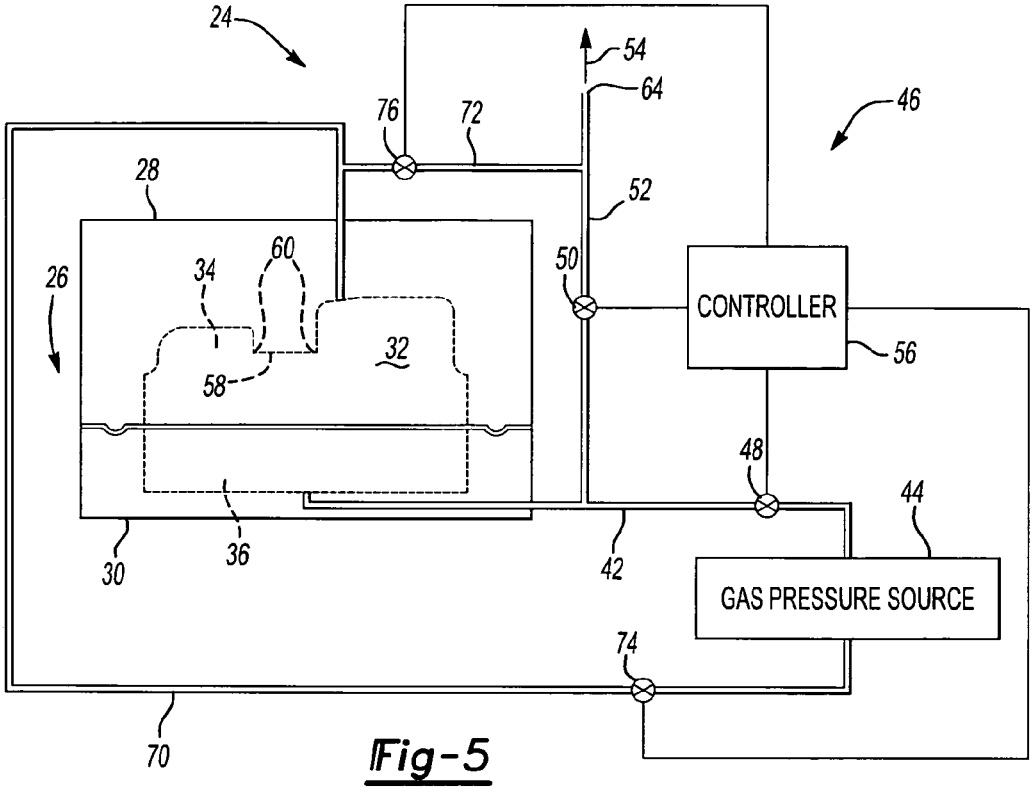
FIG. 5 is a schematic view of an alternative embodiment of an apparatus according to the present invention for managing gas pressure used in a superplastic forming process.

Turning now to FIG. 5, there is shown an alternative embodiment of the present invention. The gas management system 46 includes an additional gas inlet line 70 connecting the gas pressure source 44 to the upper die shoe 28, and correspondingly, the upper portion or section 34 of the mold cavity 32. In addition, a second gas outlet line 72 is connected to the gas inlet line 70 on one end thereof. The second gas outlet line 72 is also connected to the gas outlet line 52, and as set forth above, vents the gas from the upper portion 34 of the mold cavity 32 to the exhaust port 64, in the direction of the arrow 54. Additional valves 74, 76 are placed on the respective gas inlet and gas outlet lines 70, 72. As with the previous embodiment, the valves 74, 76 are connected to the controller or control unit 56 which operates to open and close the valves 74, 76 to control the pressure in the upper portion or section 34 of the mold cavity 32.

Figure 6A:
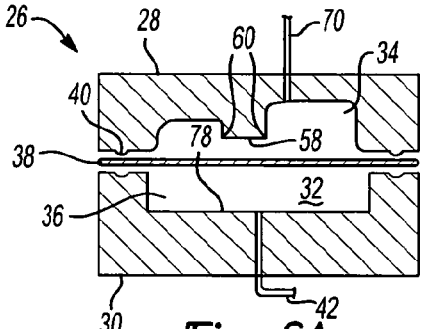
FIGS. 6A-6D are schematic representations of a workpiece undergoing a superplastic forming process in accordance with an alternative embodiment of the method of the present invention, using the embodiment of the apparatus shown in FIG. 5.
Figure 6B:
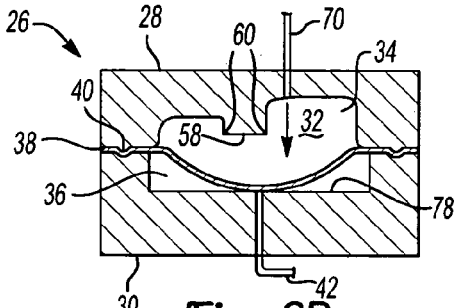
Figure 6C:
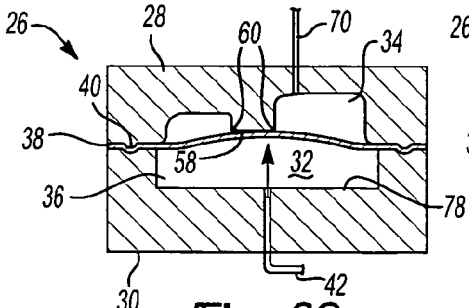
Figure 6D:
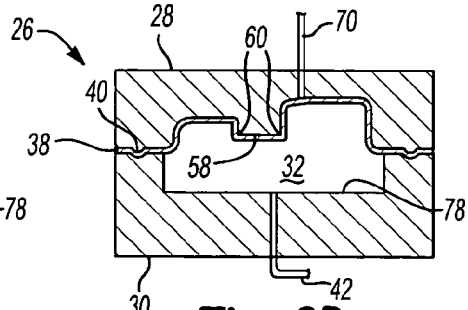

FIGS. 6A-6D illustrate schematically a workpiece 38 being formed with an apparatus according to the alternative embodiment. As shown in FIG. 6A, initially the controller or control unit 56 closes the valve 76 on the gas outlet line 72 and then opens the valve 74 on the gas inlet line 70 allowing gas to flow into the upper portion or section 34 of the mold cavity 32. The gas pressure in the upper portion or section 34 of the mold cavity 32 causes the workpiece 38 to deflect downward into the lower portion or section 36 of the mold cavity 32. Gas pressure is supplied to the upper portion or section 34 of the mold cavity 32 until the workpiece 38 either contacts, or is almost in contact, with the surface 78 of the lower portion or section 36 of the mold cavity 32, see FIG. 6B. Driving the workpiece 38 downward, towards the surface 78 of the lower portion or section 36 of the mold cavity 32, pre-stretches the workpiece 38. Thus, this procedure provides a method to uniformly stretch the workpiece 38 prior to the forming process. While this step is disclosed herein using a constant pressure, the valves 74, 76 can be controlled by the controller or control unit 56 as set forth above to vary the gas pressure in accordance with a predetermined pressure profile that may include increasing and decreasing the pressure over a period of time. Accordingly, the gas pressure driving the workpiece 38 downward toward the surface 78 of the lower portion or section 36 of the mold cavity 32 can vary over time. It should be understood that changing the pressure also varies the forming time.

When the workpiece 38 is near the surface 78 of the lower portion or section 36 of the mold cavity 32, the controller or control unit 56 closes the valve 74 on the gas inlet line 70 and opens the valve 76 on the gas outlet line 72 to vent the gas pressure. The controller or control unit 56 after closing the valve 50 on the gas outlet line 52 opens the valve 48 on the gas inlet line 42 allowing gas to flow into the lower portion or section 36 of the mold cavity 32. Similar to the previous embodiment, the controller or control unit 56 then controls or regulates the gas pressure in the lower portion or section 36 of the mold cavity 32 to control the rate of deformation of the workpiece 38 during the forming process.

It will be realized, however, that the foregoing specific embodiments have been shown and described for the purposes of illustrating the functional and structural principles of the invention and is subject to change without departure from such principles. Therefore, this invention includes all modifications encompassed within the scope of the following claims.

What is claimed is:

1. A method for forming a workpiece comprising the steps of:

providing a forming die including first and second die members operative to move between a first open position and a second sealed position wherein when said forming die is in said second sealed position, a mold cavity is formed by the first and second die members;

placing the workpiece in the forming die and moving the forming die to the second sealed position wherein the workpiece is positioned in the mold cavity;

using gas pressure to form the workpiece, the gas pressure acting on at least one side of the workpiece in the mold cavity to form the workpiece;

managing the gas pressure used to form a workpiece in accordance with a predetermined pressure profile wherein said pressure profile includes at least one reduction of pressure during the forming process, said at least one reduction of pressure occurring prior to fully forming the workpiece; and venting the gas pressure, wherein the reduction of pressure occurs prior to venting the gas pressure.

2. A method for forming a workpiece according to claim 1 wherein the step of managing the gas pressure includes raising the gas pressure until the gas pressure reaches a first pressure, and reducing the gas pressure to a second pressure, the second pressure lower than the first pressure.

3. A method for forming a workpiece according to claim 2 wherein the step of managing the gas pressure includes the step of raising the gas pressure to a third pressure after the gas pressure is reduced to the second pressure, said third pressure being greater than said second pressure.

4. A method for forming a workpiece according to claim 1 wherein the step of managing the gas pressure used to form the workpiece includes the step of controlling the gas pressure on one side of the workpiece to control the rate of deformation in at least a portion of the workpiece and subsequently reducing the gas pressure on one side of the workpiece to reduce the rate of deformation in at least a portion of the workpiece.

5. A method for forming a workpiece according to claim 1 wherein the step of managing the gas pressure used to form the workpiece includes injecting gas into the mold cavity on one side of the workpiece in accordance with a pressure-time profile that includes multiple variations of the gas pressure.

6. A method for forming a workpiece according to claim 1 wherein the step of managing the gas pressure used to form the workpiece includes the step of varying the gas pressure in the mold cavity on one side of the workpiece to control the deformation rate of the workpiece.

7. A method for forming a workpiece according to claim 1 wherein the step of managing the gas pressure used to form the workpiece includes the step of varying the gas pressure within the mold cavity on one side of the workpiece in accordance with the configuration of the forming surface of the forming die.

8. A method for forming a workpiece according to claim 1 wherein the step of managing the gas pressure used to form the workpiece includes the step of varying the pressure in the mold cavity on one side of the workpiece according to a predetermined pressure-time curve to control the deformation rate of the workpiece depending upon the configuration of the forming surface of the forming die.

9. A method for forming a workpiece comprising the steps of:

providing a forming die including first and second die members operative to move between a first open position and a second sealed position wherein when said forming die is in said second sealed position, a mold cavity is formed by the first and second die members;

placing the workpiece in the forming die and moving the forming die to the second sealed position wherein the workpiece is positioned in the mold cavity;

using gas pressure to form the workpiece, the gas pressure acting on at least one side of the workpiece in the mold cavity to form the workpiece;

managing the gas pressure used to form a workpiece in accordance with a predetermined pressure profile wherein said pressure profile includes at least one reduction of pressure during the forming process;

venting the gas pressure, wherein the reduction of pressure occurs prior to venting the gas pressure; and wherein the step of managing the gas pressure used to form the workpiece includes the step of injecting gas at a first pressure until the workpiece reaches a predetermined position in the mold cavity, reducing the pressure from said first pressure to a second pressure and then subsequently increasing the pressure from the second pressure to a third pressure.

10. A method for forming a workpiece comprising the steps of:

providing a forming die including first and second die members operative to move between a first open position and a second sealed position wherein when said forming die is in said second sealed position, a mold cavity is formed by the first and second die members when one of the first and second die members has a forming surface against which the workpiece is pressed to form the workpiece and the other die member having a non-forming surface;

placing the workpiece in the forming die and moving the forming die to the second sealed position wherein the workpiece is positioned in the mold cavity between the forming surface and the non-forming surface;

using gas pressure to form the workpiece, wherein gas pressure in the mold cavity acts on the workpiece to form the workpiece;

managing the gas pressure used to form a workpiece including applying pressure on one side of the workpiece to urge the workpiece away from the forming surface and toward the non-forming surface, before the workpiece reaches the non-forming surface applying pressure to the opposite side of the workpiece to urge the workpiece toward and ultimately against the forming surface of the forming die, wherein applying pressure to the workpiece to urge the workpiece toward the forming surface of the forming die includes varying the gas pressure in the mold cavity used to urge the workpiece toward the forming surface, including at least one reduction of the gas pressure, to control the deformation rate of the workpiece; and venting the gas pressure.

11. A method for forming a workpiece according to claim 10 wherein the step of managing the gas pressure used to form the workpiece includes varying the pressure in the mold cavity according to a predetermined pressure-time curve to control the deformation rate of the workpiece depending upon the configuration of the forming surface of the forming die.

* * * * *